US006223349B1

(12) United States Patent
Roiser

(10) Patent No.: US 6,223,349 B1
(45) Date of Patent: May 1, 2001

(54) CLOSURE DEVICE FOR SLIT OPENING OF AQUATIC SPORT SUIT

(76) Inventor: Erich Roiser, St. Lorenz 300, A-5310 Mondsee (AT)

( * ) Notice: Subject to any disclaimer, the term of this patent is extended or adjusted under 35 U.S.C. 154(b) by 0 days.

(21) Appl. No.: 09/579,195

(22) Filed: May 26, 2000

(30) Foreign Application Priority Data

May 27, 1999 (AT) ..... 945/99

(51) Int. Cl.[7] ..... B63C 11/04; A44B 1/04

(52) U.S. Cl. ..... 2/2.17; 2/2.15; 2/82; 24/381

(58) Field of Search ..... 2/2.15, 69, 79, 2/2.16, 2.17, 82, 243.1, 270, 227, 234; 24/381, 382, 384, 385, 386, 387, 388, 389, 390, 432

(56) References Cited

U.S. PATENT DOCUMENTS

| | | | | |
|---|---|---|---|---|
| 2,746,113 | * | 5/1956 | Williams | 24/389 |
| 2,853,758 | * | 9/1958 | Topf | 2/227 |
| 4,987,657 | * | 1/1991 | Moreland | 24/389 |
| 5,159,719 | * | 11/1992 | Aumann | 2/87 |
| 5,444,898 | * | 8/1995 | Norvell | 24/389 |
| 5,924,172 | * | 7/1999 | Klein | 24/389 |
| 6,092,266 | * | 7/2000 | Lee | 24/389 |
| 6,105,214 | * | 8/2000 | Press | 24/389 |

FOREIGN PATENT DOCUMENTS

| | | |
|---|---|---|
| 296 05 646 | 7/1996 | (DE) . |
| WO 97/07702 | 3/1997 | (WO) . |

* cited by examiner

*Primary Examiner*—Gloria M. Hale
(74) *Attorney, Agent, or Firm*—Darby & Darby

(57) ABSTRACT

A closure device for slit openings of aquatic sport suits, in particular of suits made of chloroprene rubber, with zippers which close the slit opening arranged both on the outside and on the inside of the aquatic sport suit. Both halves of the zipper are secured along the slit opening in close proximity to the sides of the opening. Two mutually overlapping tabs which also overlap the slit opening may be arranged on the inside of the aquatic sport suit along both sides of the slit opening. At least one sealing device is provided between the zippers (4, 8) which are arranged on the outside (1) and the inside (5) of the aquatic sport suit (2). If necessary, the zipper (8) disposed on the inside (5) is attached to two strips (12, 13; 12', 13') which are disposed on the inside (5) of the aquatic sport suit (2) and extend lengthwise along the slit opening (3), with the zipper (8) closing an opening region (3') formed between the two strips (12, 13; 12', 13').

12 Claims, 6 Drawing Sheets

CLOSURE DEVICE FOR SLIT OPENING OF AQUATIC SPORT SUIT

BACKGROUND OF THE INVENTION

1. Field of the Invention

The present invention relates to a closure device for slit openings of aquatic sport suits, in particular of suits made of chloroprene rubber, wherein zippers which close the slit opening, are arranged both on the outside and on the inside of the aquatic sport suit. Both halves of the zipper are secured along the slit opening in close proximity to the sides of the slit opening. Two mutually overlapping tabs which also overlap the slit opening may also be arranged on the inside of the aquatic sport suit along both sides of the slit opening.

2. Description of the Related Art

Conventional aquatic sport suits made of chloroprene rubber have a zipper placed on the outside of the suit for closing the slit opening, with the two halves of the zipper attached along the slit opening in close proximity to the slit opening. To prevent water from penetrating through the slit opening, two mutually overlapping tabs which also overlap the slit opening are secured on the inside of the aquatic sport suit on both sides of the slit opening.

Disadvantageously, the closure systems of conventional aquatic sport suits seal inadequately and unsatisfactorily. The zipper itself is not waterproof and is also not capable of preventing the walls of the slit from spreading apart when the aquatic sport suit is worn so as to effectively prevent penetration of water. The mutually overlapping tabs which are arranged on the inside of the aquatic sport suit and overlap the length of the slit in the center, aid in sealing the slit opening, but cannot effectively prevent water from penetrating.

For example, WO 97/07702 discloses closure devices for clothing items, wherein slit openings can be closed using a dual zipper or two separate zippers arranged on top of one another. The respective outer edges of the tapes of the zippers facing away from the inner edges and holding the closure elements are connected with one another and also with the material adjacent to the slit opening. The zipper arranged on the outside provides a watertight closure, wherein the zipper arranged on the inside has interlocking teeth.

Using a specially constructed watertight zipper, however, has certain disadvantages. Disadvantageously, zippers that seal satisfactory against water are rather expensive. On the other hand, such zippers can support only limited tension forces. Since the zippers can be subjected to excessive transverse forces, for example, during a sudden body movement, such closure devices may inadvertently open.

DE 296 05 646 U1 discloses overalls for, for example, motorcyclists and mechanics and include sections which can be connected with a single zipper. To prevent water, such as rain water, from penetrating the area closed by the zipper, closure strips are arranged above and below the zipper. However, the free ends of the closure strips must also include closure elements.

It is therefore an object of the invention to provide an inexpensive closure device for slit openings of aquatic sport suits, which provide an adequate seal and have a simple design. Moreover, such closure device should also overcome or at least significantly lessen the aforedescribed disadvantages of conventional closure devices. In addition, improving the conventional closure devices should be easily attainable by simple means.

SUMMARY OF THE INVENTION

The object is solved by the invention by providing at least one sealing arrangement located between the zippers which are arranged on the outside and the inside of the aquatic sport suit. The zipper disposed on the inside is attached to two strips which are disposed on the inside of the aquatic sport suit and extend lengthwise along the slit opening, with the zipper closing an opening region formed between the two strips.

This arrangement of the closure device advantageously provides a simple and effective sealing device between the two zippers.

According to another advantage of the closure device of the invention, conventional inexpensive zippers can be used which are capable of withstanding the considerable tensile forces produced when the aquatic sport suit is worn.

According to yet another embodiment of the invention, the slit opening and the opening region are offset with respect to one another, wherein preferably one of the two strips covers the slit opening. With this simple arrangement of the closure device, water is prevented from penetrating by securing the zipper, which is disposed on the inside, to two strips which are arranged on the inside of the aquatic sport suit and extend lengthwise along the slit opening.

According to yet another embodiment of the closure device of the invention, the sealing device consists of a sealing tab which is arranged on at least one side along the slit opening and the opening region, respectively, and extends at least to the longitudinal center of the slit opening or the opening region.

The sealing tab is advantageously attached in the region of at least one of the two zippers of the aquatic sport suit.

According to yet another embodiment of the invention, the sealing tab is arranged immediately underneath one of the zipper halves disposed on the outside of the aquatic sport suit or immediately underneath one of the zipper halves which connects the strips and is disposed on the inside of the aquatic sport suit.

According to another advantageous embodiment of the invention, the sealing tab is provided with a sealing bead on the side facing the slit opening and/or the opening region, with the sealing bead preferably having a substantially circular cross-section. When the two zippers are closed, the sealing bead which is made of rubber or an elastic material, is pressed against the slit edges and at least partially between the walls of the slit opening and/or the opening region. In this way, the closure device of the invention provides an effective seal against penetration of water.

To further improve the sealing effect of the closure device, the invention provides an additional sealing strip which extends in the longitudinal direction of the slit opening and is located on the inside of the aquatic sport suit in the region between the slit opening and the free longitudinal marginal edge of the inner tab which covers the slit opening.

According to yet another embodiment of the closure device of the invention, the sealing device consists of a tapered section of at least one of the two slit walls, wherein the tapered section extends over the length of the slit opening. According to another embodiment of the invention, the tapered section of one of the slit walls engages with a recess of the other slit wall.

When the zippers are closed, the tapered section is pressed into the recess and against the slit wall, thereby attaining a satisfactory sealing effect.

According to yet another embodiment of the closure device of the invention, each of the slit walls is provided with a respective tapered section, wherein the tapered sections overlap each other. When the zippers are closed, the two beveled surfaces of the tapered section are pressed against each other. This simple sealing device also provides a satisfactory sealing effect.

According to yet another advantageous embodiment of the invention, the tabs, sealing tabs, sealing beads, sealing strips, the tapered section and the strips are made of smooth chloroprene rubber or chloroprene rubber coated with nylon.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
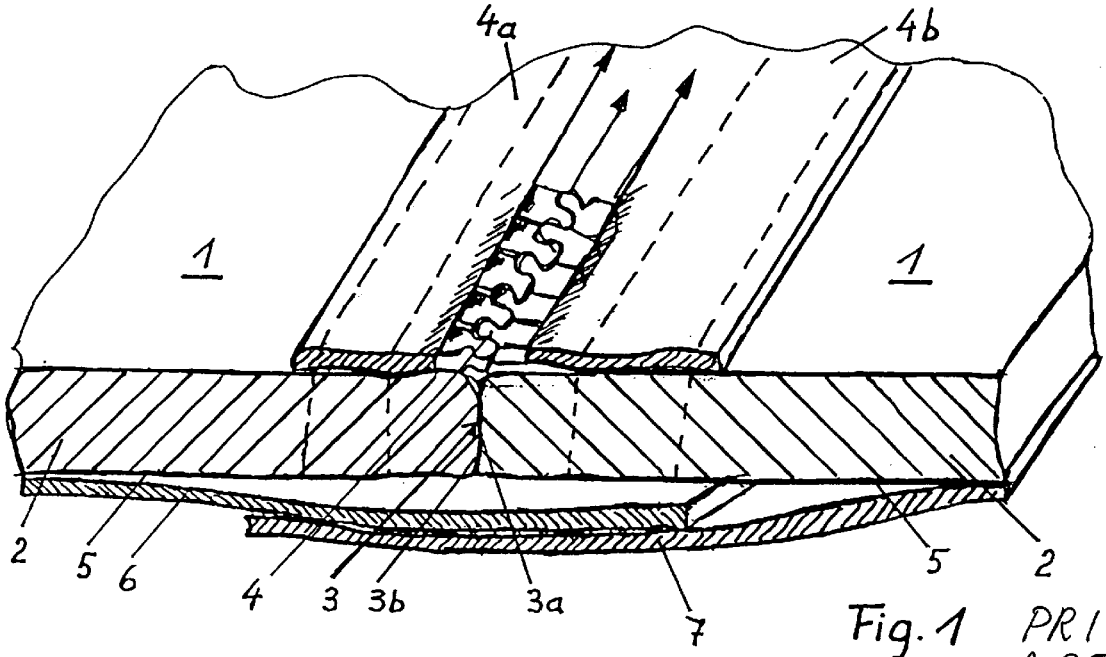
Fig. 1 PRIOR ART
FIGS. 1 to 3 are partial views of a conventional closure device for a slit opening of an aquatic sport suit.
Figure 2:
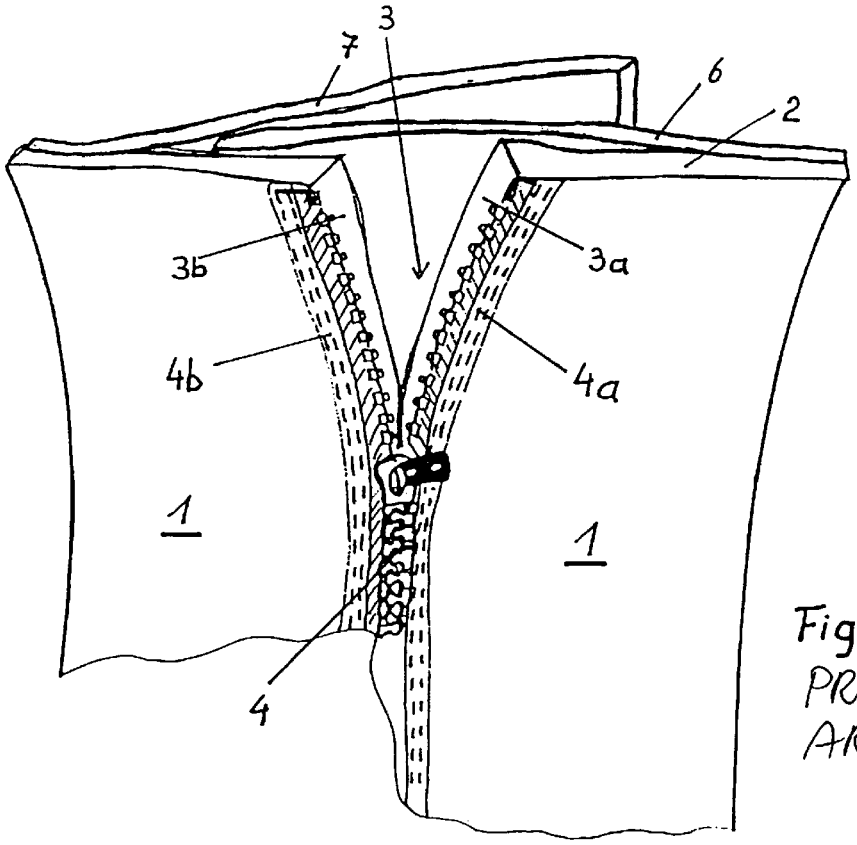
Fig. 2 PRIOR ART
Figure 3:
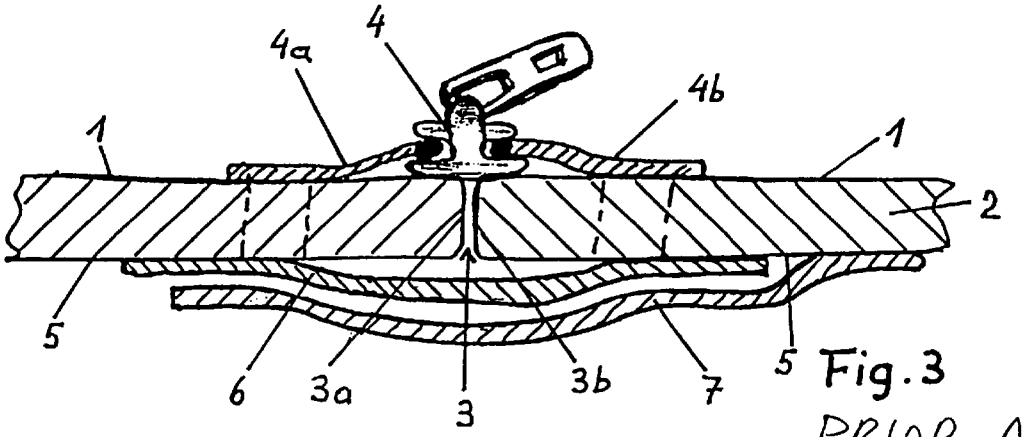
Fig. 3 PRIOR ART

FIGS. 1 to 3 show a conventional closure device, wherein a zipper 4 for closing a slit opening 3 is arranged on the outside 1 of an aquatic sport suit 2 made of chloroprene rubber. The two zipper halves 4*a*, 4*b* are each secured along and in close proximity to the sides of the slit opening. With the zipper 4 closed, the walls 3*a*, 3*b* of the slit opening 3, i.e., the sections of the aquatic sport suit 2 which are separated by a slit, are abutting one another at the center of the zipper.

On the inside 5 of the aquatic sport suit 2, mutually overlapping tabs 6, 7 which also overlap the slit opening 3, are secured on both sides of the slit opening 3.

Figure 4:
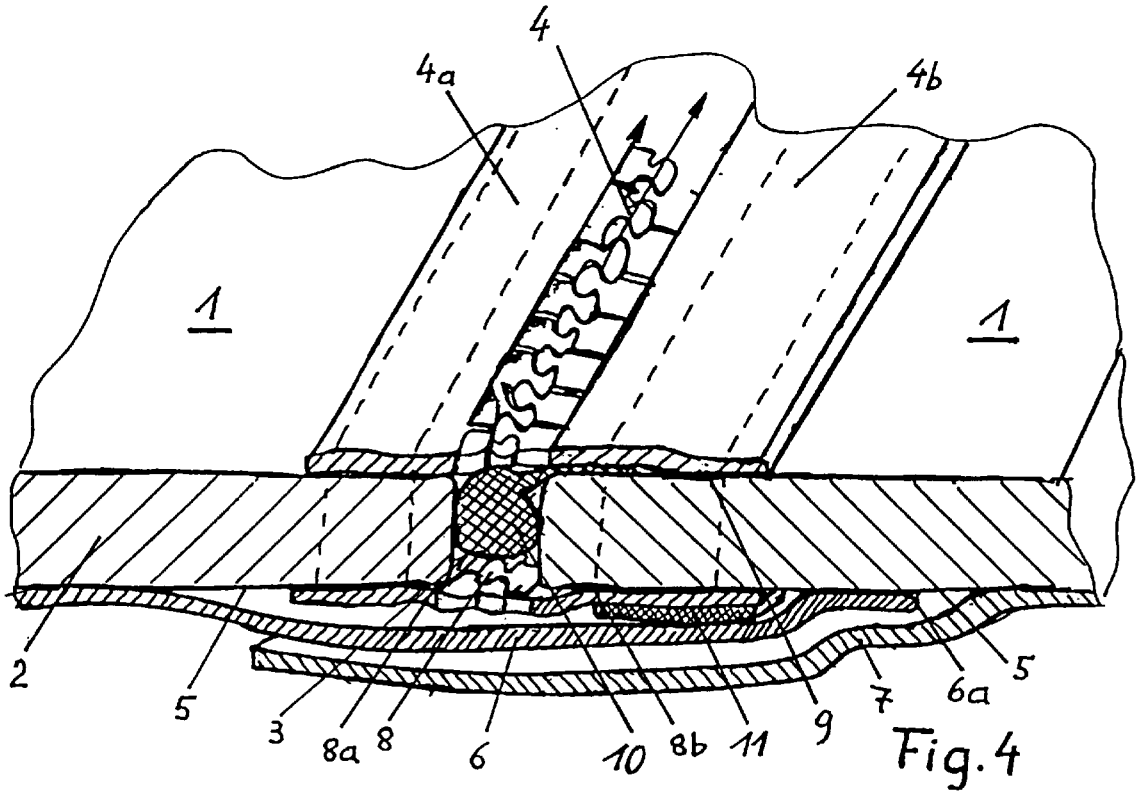
FIGS. 4 to 6 are partial views of a first embodiment.
Figure 6:
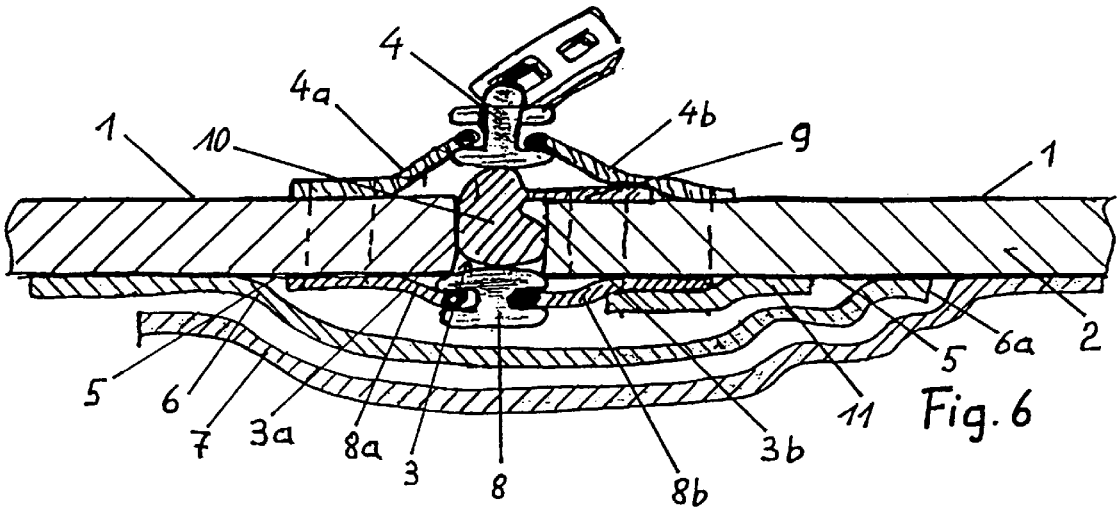
Figure 5:
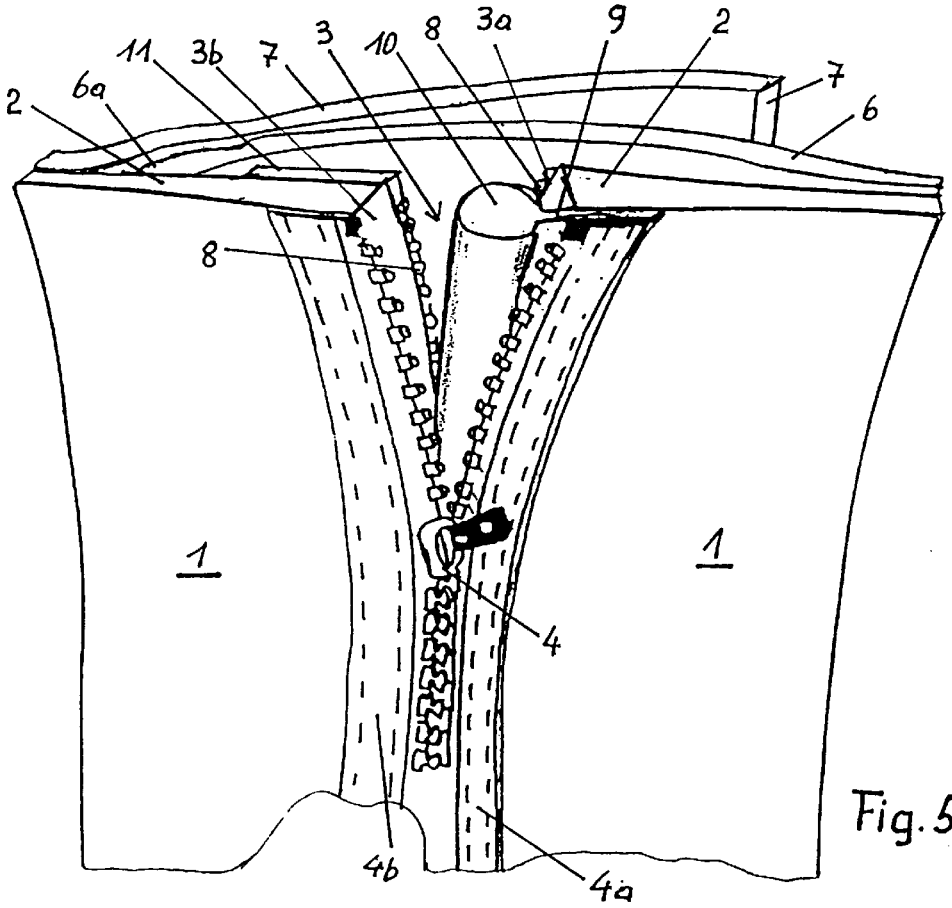

FIGS. 4 to 6 depict a closure device according to the invention, wherein a zipper 4 for closing a slit opening 3 is disposed on the outside 1 of the aquatic sport suit 2 which is made of chloroprene rubber. A second zipper 8 which can be operated from the outside 1 and also closes the slit opening 3, is disposed on the inside 5 of the aquatic sport suit 2.

The zipper 4 disposed on the outside 1 and the zipper 8 disposed on the inside 5 of the aquatic sport suit 2 can be placed essentially in an overlapping arrangement, wherein the two halves 4*a*, 4*b* of the zipper 4 disposed on the outside 1 as well as the two halves 8*a*, 8*b* of the zipper 8 disposed on the inside 5 of the aquatic sport suit 2 are secured along and in close proximity to the slit opening 3. When the zippers 4, 8 are closed (not shown), the walls 3*a*, 3*b* of the slit opening 3, i.e. the sections of the aquatic sport suit 2 which are separated by the slit, abut each other at the center of the two zippers 4, 8. By placing the two zippers 4, 8 on the outside 1 and the inside 5 of the aquatic sport suit 2, respectively, the slit walls 3*a*, 3*b* are prevented from spreading apart, thereby also preventing water from penetrating the slit 3.

The sealing ability of the closure device of the invention is further improved by attaching on at least one side along the slit opening 3 in a region between the two zippers 4, 8 an additional sealing device, in the present example a sealing device in the form of a sealing tab 9 extending at least to the longitudinal center of the slit opening 3. The sealing tab 9 is preferably made of rubber or another elastic material and has on the side facing the slit opening 3 a sealing bead 10, preferably with an essentially circular cross-section and formed as onepiece with the sealing tab 9.

The sealing tab 9 is preferably positioned immediately underneath one of the halves 4*a*, 4*b* of the zipper 4 disposed on the outside 1 of the aquatic sport suit 2; however, the sealing tab 9 may also be placed between one of the halves 8*a*, 8*b* of the zipper 8 disposed on the inside 5 of the aquatic sport suit 2.

When the two zippers 4, 8 are closed, the sealing bead 10 is pressed against the edges of the slit opening 3 or pressed between the two walls 3*a*, 3*b* of the slit opening 3 of the aquatic sport suit 2, thereby significantly enhancing the sealing function of the sealing arrangement.

The closure device of the invention preferably includes mutually overlapping tabs 6, 7 arranged on the inside 5 of the aquatic sport suit 2 and secured on both sides along the slit opening 3 and overlapping the slit opening 3. The tabs 6, 7 enhance the sealing functionality of the sealing arrangement and also prevent direct skin contact by the wearer of the aquatic sport suit 2.

To further improve the sealing ability of the closure device, an additional sealing strip 11 extending in the longitudinal direction of the slit opening 3 is arranged on the inside 5 of the aquatic sport suit 2 in the region between the slit opening 3 and the free longitudinal marginal edge 6*a* of the inner tab 6 which covers the slit opening 3.

The tabs 6, 7, the sealing tab 9 and the sealing strip 11 are preferably made of smooth chloroprene rubber. However, the chloroprene rubber coated with nylon can also be used.

Figure 7:
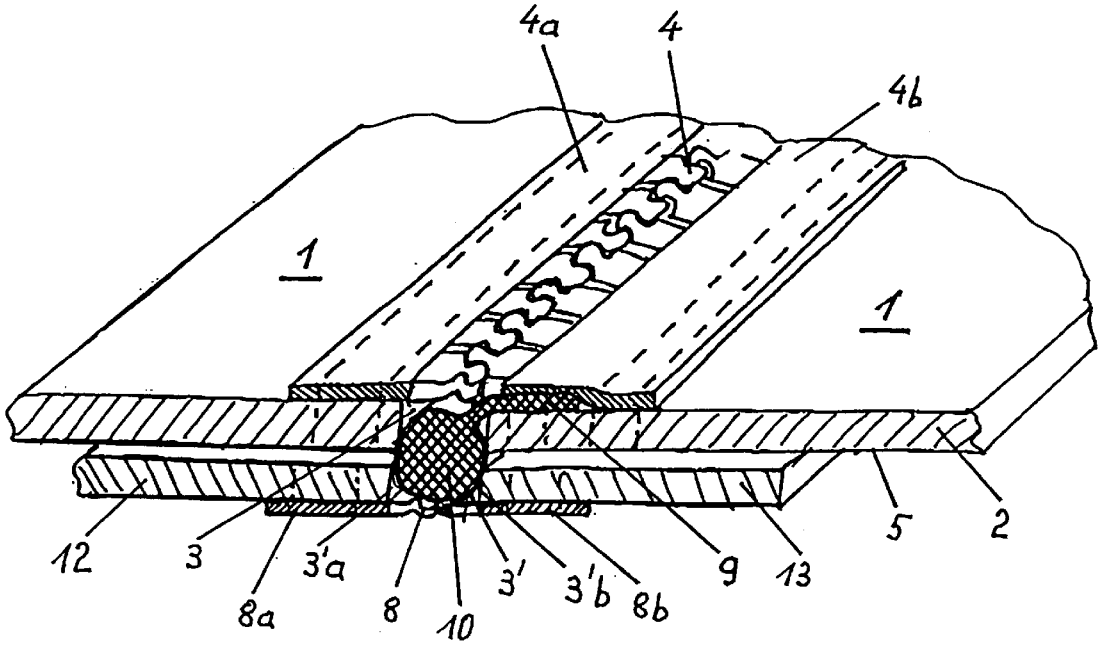
FIGS. 7 and 8 are partial views of a second embodiment.
Figure 8:
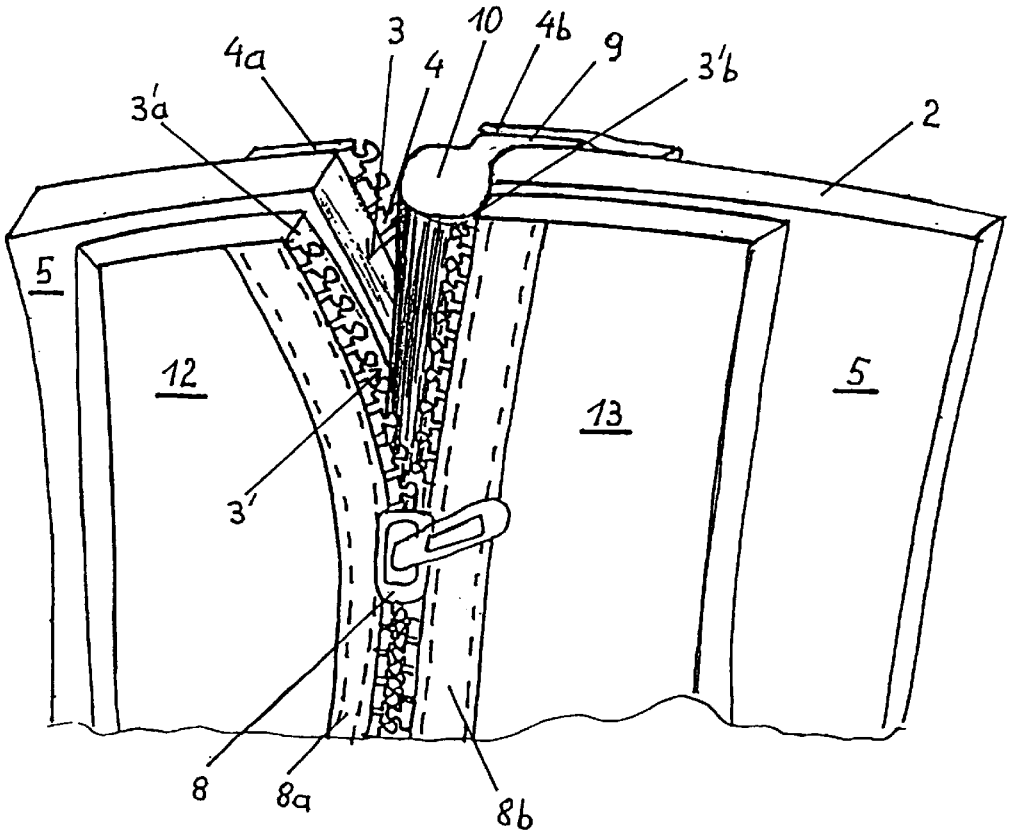

In the embodiment illustrated in FIGS. 7 and 8, the outer zipper 4 for closing the slit opening 3 is arranged on the outside 1 of the aquatic sport suit 2 which is made of chloroprene rubber. Strips 12, 13 formed of chloroprene rubber are attached to the inside 5 on both sides of the slit opening 3 and extend lengthwise along the slit opening 3. The opposing inner edges 3'*a*, 3'*b* of the strips 12, 13 extend to the opening region 3' located below the slit opening 3.

For closing the opening region 3', which corresponds to the slit opening 3 located between the strips 12, 13, the inner zipper 8 in this embodiment is disposed on the strips 12, 13.

For sealing the slit opening 3 and/or the opening region 3' located underneath, the sealing tab 9 which extends at least to the longitudinal center of the slit opening 3 and/or the opening region 3' located underneath, is secured between the two zippers 4, 8 at least on one side along the slit opening 3 and the opening region 3' below. Advantageously, the sealing tab 9 is secured underneath one of the halves 4*a*, 4*b* of the outer zipper 4 on the outside 1 of the aquatic sport suit 2. Preferably, the sealing tab 9 which is made of rubber or an elastic material is provided with a sealing bead 10 on the side facing the slit opening 3 and the opening region 3' located underneath. The sealing bead 10 preferably has a substantially circular cross-section and is formed as onepiece with the sealing tab 9.

When the two zippers 4, 8 are closed, the sealing bead 10 is pressed into the slit opening 3 and the opening 3' below of the aquatic sport suit 2, thereby attaining a substantially watertight closure device.

Figure 9:
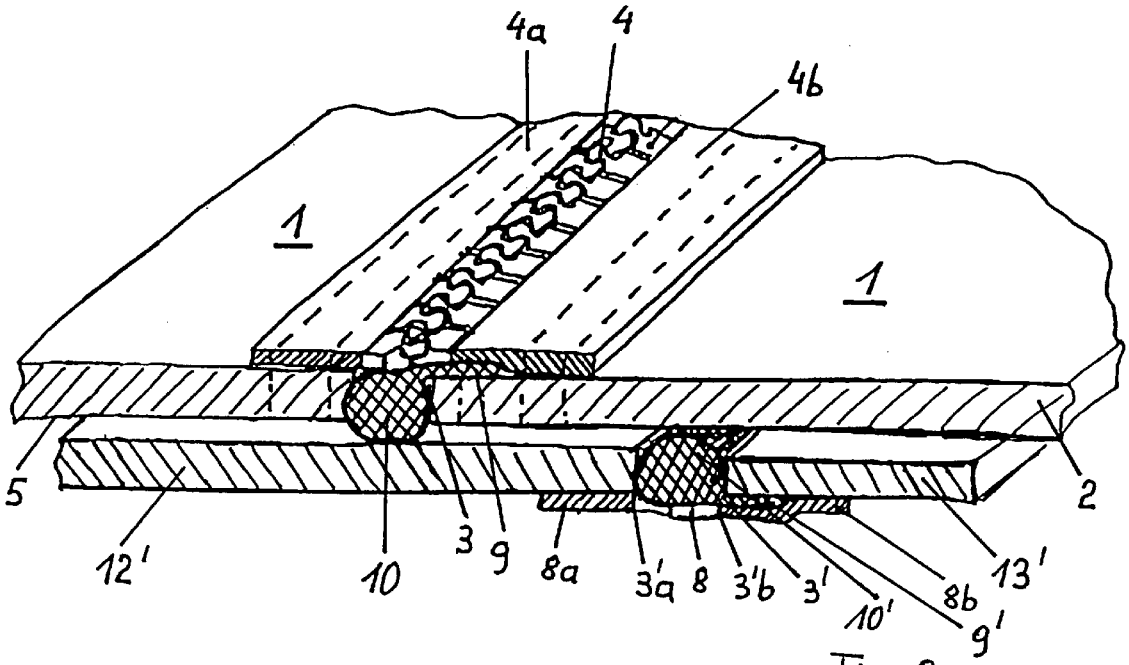
FIGS. 9 and 10 are partial views of a third embodiment.
Figure 10:
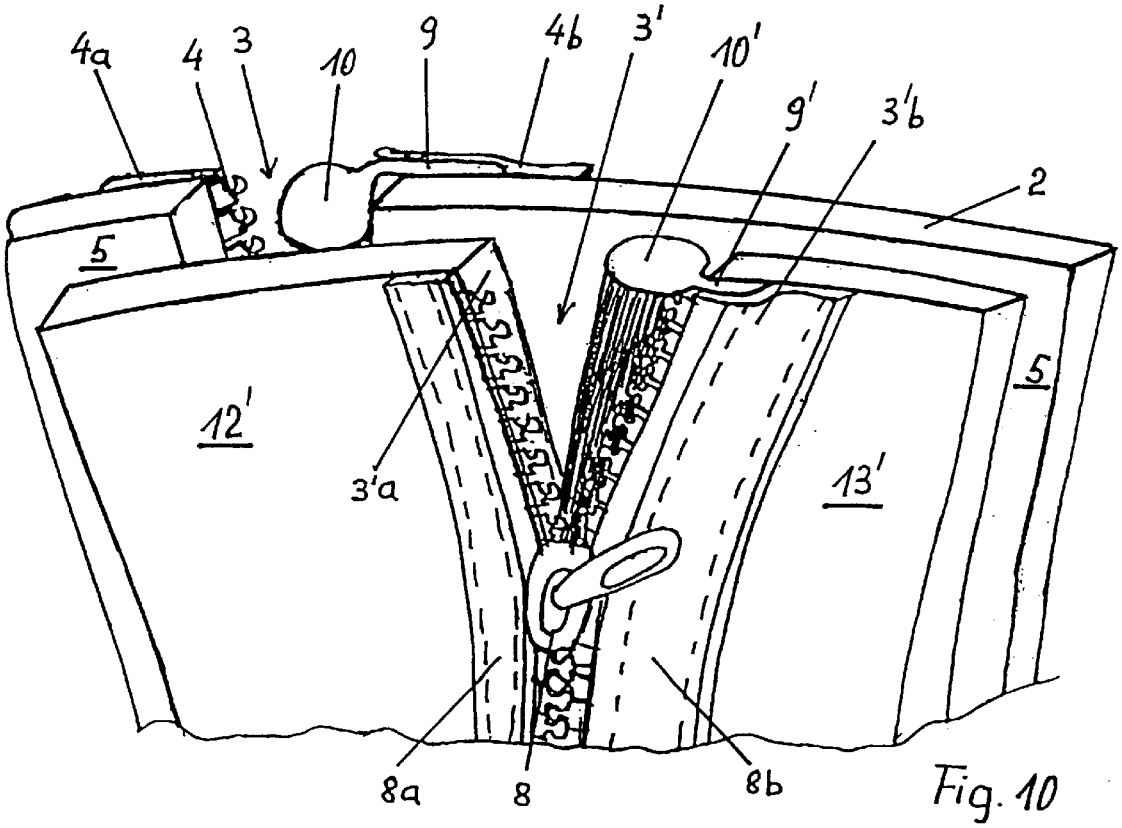

According to the embodiment of the closure device of the invention illustrated in FIGS. 9 and 10, the outer zipper 4 for closing the slit opening 3 is disposed on the outside 1 of the aquatic sport suit 2 made of chloroprene rubber. Strips 12', 13' which are formed of chloroprene rubber, are secured on the inside 5 and extend lengthwise along the slit opening 3 and the opening region 3', respectively. The opposing inner edges 3'*a*, 3'*b* extend to the opening region 3' which is offset from the slit opening 3. Depending on the direction of the offset between the two zippers 4 and 8 or between the slit opening 3 and the opening region 3', respectively, one of the sealing strips 12', 13' projects over and covers the slit opening 3. For closing the opening region 3' between the strips 12', 13', the inner zipper 8 in this arrangement is attached to the strip 12', 13'.

For sealing the slit opening 3 and the opening region 3' which is offset with respect to the slit opening 3, at least one sealing tab 9, 9' which extends at least to the longitudinal center of the slit opening 3 and/or the opening region 3', is attached at least on one side of the slit opening 3 and the opening region 3' in the region of the two zippers 4, 8. Advantageously, the sealing tab 9 is secured underneath one of the halves 4*a* or 4*b* of the outer zipper 4 on the outside 1 of the aquatic sport suit 2, and the sealing tab 9' is attached to the strips 12' and 13' underneath one of the halves 8*a* or 8*b* of the inner zipper 8.

According to the embodiment of the closure device of the invention illustrated in FIGS. 9 and 10, the sealing tabs 9 and 9' provided for sealing the slit opening 3 and the opening region 3' are provided with a respective sealing bead 10, 10' on the side facing the slit opening 3 and/or the opening region 3'. Preferably, the sealing beads 10 and 10' have a substantially circular cross-section and are formed as one-piece with the sealing tab 9, 9'.

Advantageously, the sealing tabs 9, 9' as well as the sealing beads 10, 10' are made of rubber or of an elastic material.

When the two zippers 4, 8 are closed, the sealing beads 10, 10' are each pressed into the slit opening 3 and the opening region 3', thereby providing an essentially water-tight seal of the closure device. In addition, depending on the direction of the mutual offset between the slit opening 3 and the opening region 3', the sealing bead 10 is also pressed against one of the strips 12' or 13' covering the slit opening 3, thereby further improving the sealing function of the closure device.

The mutual offset between the slit opening 3 and the opening region 3' significantly facilitates the use of a sealing tab 9, 9', in particular, with the sealing bead 10, 10' provided on the sealing tab 9, 9', since the sealing tab 9, 9' and the sealing bead 10, 10' provide an excellent seal and do not interfere with each other when the zippers 4, 8 are closed.

The strips 12, 13; 12', 13' as well as the sealing tabs 9; 9' and the sealing beads 10; 10' are preferably made of smooth chloroprene rubber or chloroprene rubber coated with nylon. All seams, for example the seams at the zippers 4 and 8, are welded to further improve the sealing function of the closure device of the invention.

Figure 11:
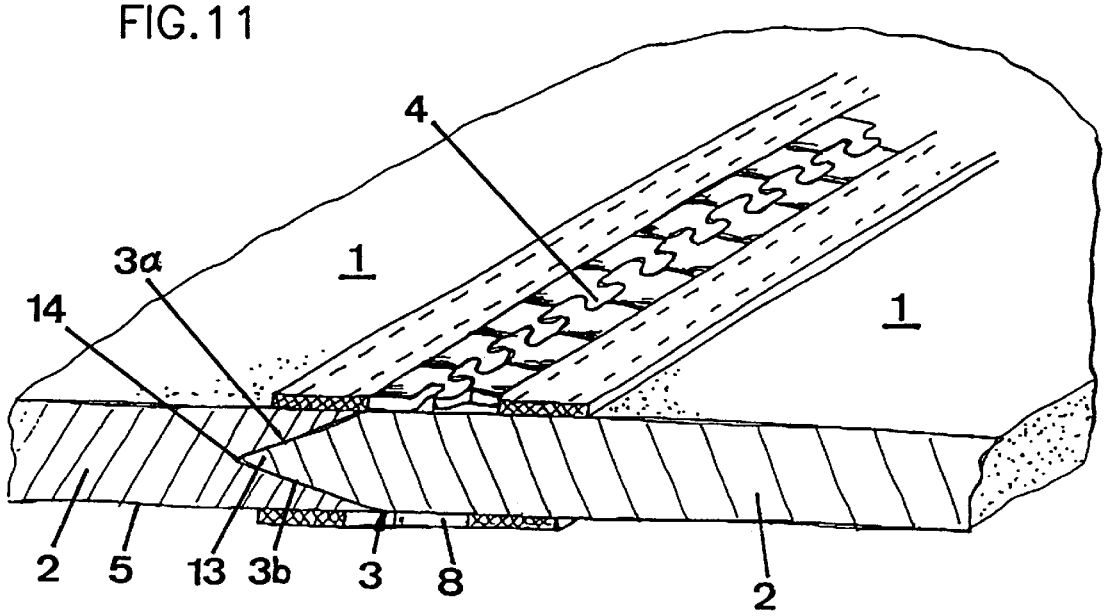
FIG. 11 is a partial view of a fourth embodiment.
Figure 12:
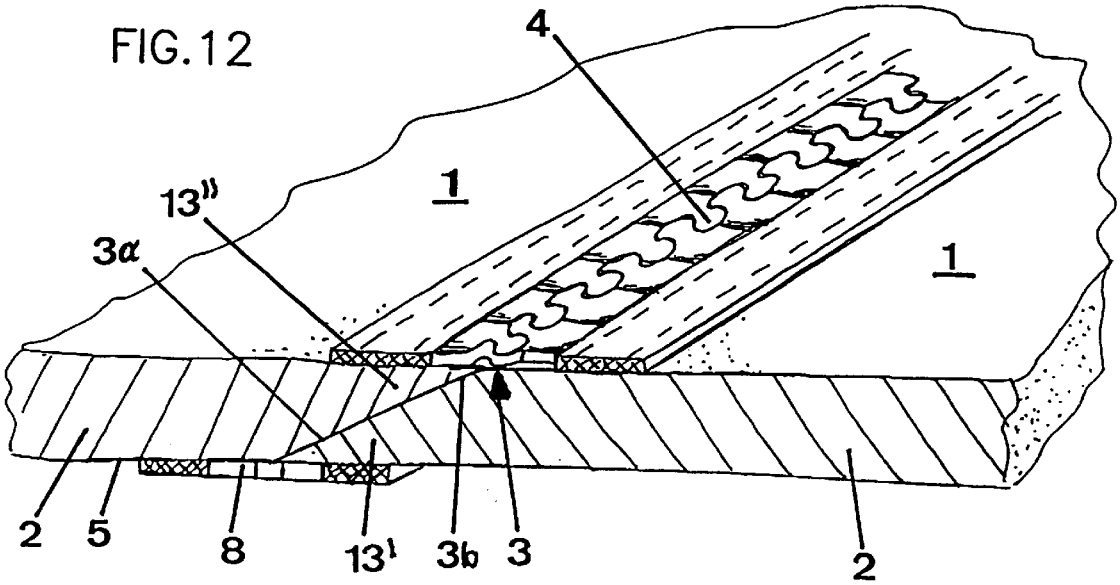
FIG. 12 is a partial view of a fifth embodiment of closure devices according to the invention for closing a slit opening of an aquatic sport suit.

According to the embodiment of the closure device of the invention illustrated in FIGS. 11 and 12, respective zippers 4 and 8 for closing the slit opening 3 are placed on the outside 1 and the inside 5, respectively, of the aquatic sport suit 2.

According to the embodiment illustrated in FIG. 11, the additional sealing device consists of a tapered section 13 of the wall 3*b* of the slit opening 3. The tapered section 13 which has a wedge-shaped cross-section, projects into a recess 14 of the other slit wall 3*a*. When the zippers 4, 8 are closed, the tapered section 13 presses further into the recess 14 and against the slit wall 3*a*, thereby providing an adequate sealing function.

According to the closure device depicted in FIG. 12, each of the two slit walls 3*a*, 3*b* has a tapered section 13', 13", with the opposing parallel sloped surfaces which form the slit walls 3*a*, 3*b* completely overlapping one another, thereby forming the sealing device. When the zippers 4, 8 are closed, the sloped surfaces of the tapered sections 131, 13" are pressed against one another, so that this extremely simple sealing device also provides a satisfactory sealing effect.

Each of the tapered sections 13; 13', 13" extends over the entire length of the slit opening 3.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A closure device for a slit opening of an aquatic sport suit, in particular a suit made of chloroprene rubber, comprising at least one zipper arranged on an outside of the aquatic sport suit and at least one zipper arranged on an inside of the aquatic sport suit for closing the slit opening, each of the at least one zipper having two halves of the zipper secured along the slit opening in close proximity to each side associated to the slit opening, with two mutually overlapping tabs overlapping the slit opening arranged on the inside of the aquatic sport suit along both sides of the slit opening, at least one sealing device is provided between the zipper (4, 8) which are arranged on the outside (1) and the inside (5) of the aquatic sport suit (2), wherein the zipper (8) disposed on the inside (5) is attached to two strips (12, 13; 12', 13') which are disposed on the inside (5) of the aquatic sport suit (2) and extend lengthwise along the slit opening (3), with the zipper (8) closing an opening region (3') formed between the two strips (12, 13; 12', 13').

2. The closure device according to claim 1, wherein the slit opening (3) and the opening region (3') are offset with respect to one another; and wherein one of the two strips (12, 13; 12', 13') covers the slit opening (3).

3. The closure device according to claim 2, wherein the sealing device consists of a sealing tab (9, 9') which is arranged on at least one side along the slit opening (3) and the opening region (3'), respectively, and extends at least to the longitudinal center of the slit opening (3) or the opening region (3').

4. The closure device according to claim 3, wherein the sealing tab (9, 9') is attached to the aquatic sport suit (2) in the region of at least one of the two zippers (4, 8).

5. The closure device according to claim 4, wherein the sealing tab (9) is arranged immediately underneath one half (4*a*, 4*b*) of the zipper (4) disposed on the outside (1) of the aquatic sport suit (2).

6. The closure device according to claim 5, wherein that the sealing tab (9') is arranged immediately underneath one half (8*a*, 8*b*) of the zipper (8) which connects the strips (12', 13') and is disposed on the inside (3) of the aquatic sport suit (2).

7. The closure device according to claim 6, wherein the sealing tab (9, 9') is provided with a sealing bead (10, 10') on the side facing the slit opening (3) and the opening region (3'), respectively, with the sealing bead (10, 10') preferably having a substantially circular cross-section.

8. The closure device according to claim 7, wherein an additional sealing strip (11) extending in the longitudinal direction of the slit opening (3) and located on the inside (5) of the aquatic sport suit (2) is provided in the region between the slit opening (3) and the free longitudinal marginal edge (6*a*) of the inner tab (6) which covers the slit opening (3).

9. The closure device according to claim 1, wherein the sealing device consists of a tapered section of at least one of the two slit walls (3*a*, 3*b*), wherein the tapered section extends over the length of the slit opening (3).

10. The closure device according to claim 9, wherein the tapered section of one of the slit walls (3*a*, 3*b*) engages with a recess of the other slit wall (3*b*, 3*a*).

11. The closure device according to claim 9, wherein each of the slit walls (3*a*, 3*b*) is provided with a respective tapered section; and wherein the tapered sections overlap one another.

12. The closure device according to claim 11, wherein the tabs (6, 7), sealing tabs (9, 9'), sealing beads (10, 10'), sealing strips (11), the tapered section and the strips (12, 13; 12', 13') are made of a smooth chloroprene rubber or a chloroprene rubber coated with nylon.

* * * * *